US009282391B2

(12) United States Patent
Jung

(10) Patent No.: US 9,282,391 B2
(45) Date of Patent: Mar. 8, 2016

(54) METHOD AND APPARATUS FOR RECOGNIZING EARPHONE IN PORTABLE TERMINAL

(71) Applicant: Samsung Electronics Co. Ltd., Suwon-si, Gyeonggi-do (KR)

(72) Inventor: Rami Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 542 days.

(21) Appl. No.: 13/668,652

(22) Filed: Nov. 5, 2012

(65) Prior Publication Data

US 2013/0129109 A1 May 23, 2013

(30) Foreign Application Priority Data

Nov. 22, 2011 (KR) ..... 10-2011-0121995

(51) Int. Cl.

| | |
|---|---|
| ***H04R 1/10*** | (2006.01) |
| ***H04R 29/00*** | (2006.01) |
| *H04R 3/00* | (2006.01) |
| *H04R 5/04* | (2006.01) |

(52) U.S. Cl.

CPC ..... *H04R 1/1041* (2013.01); *H04R 29/00* (2013.01); *H04R 3/007* (2013.01); *H04R 5/04* (2013.01); *H04R 2420/05* (2013.01); *H04R 2420/09* (2013.01)

(58) Field of Classification Search

CPC ..... H04R 1/10

USPC ..... 381/74, 77, 81, 58, 384; 700/94

See application file for complete search history.

(56) References Cited

U.S. PATENT DOCUMENTS

| | | | | |
|---|---|---|---|---|
| 8,620,004 | B2 * | 12/2013 | Wu | H04M 1/6058 381/74 |
| 8,817,994 | B2 * | 8/2014 | Turner | H03K 5/1254 381/123 |
| 2010/0075723 | A1 | 3/2010 | Min et al. | |
| 2013/0142350 | A1 * | 6/2013 | Larsen | H04R 1/1041 381/74 |

FOREIGN PATENT DOCUMENTS

KR 10-2010-0034229 4/2010

* cited by examiner

*Primary Examiner* — Disler Paul

(74) *Attorney, Agent, or Firm* — Jefferson IP Law, LLP

(57) ABSTRACT

A method and an apparatus for preventing an erroneous operation according to generation of an interrupt signal during separation and mounting procedures of an earphone are provided. The method includes detecting generation of an interrupt associated with a change in a connection state between the earphone and an interface unit, determining the connection state when the generation of the interrupt is detected, determining whether a preset stabilizing time for stabilizing the change in the connection state has elapsed, determining whether the determined connection state is identical with a connection state before the generation of the interrupt when the preset stabilizing time elapses, and maintaining the connection state before the generation of the interrupt when the determined connection state is identical with the connection state before the generation of the interrupt.

18 Claims, 4 Drawing Sheets

METHOD AND APPARATUS FOR RECOGNIZING EARPHONE IN PORTABLE TERMINAL

PRIORITY

This application claims the benefit under 35 U.S.C. §119 (a) of a Korean patent application filed on Nov. 22, 2011 in the Korean Intellectual Property Office and assigned Serial No. 10-2011-0121995, the entire disclosure of which is hereby incorporated by reference.

BACKGROUND OF THE INVENTION

1. Field of the Invention

The present invention relates to a method and an apparatus for recognizing an earphone in a portable terminal. More particularly, the present invention relates to a method of recognizing an earphone in a portable terminal capable of exactly recognizing whether a connected earphone is a 3 pole antenna or a 4 pole antenna, and an apparatus thereof.

2. Description of the Related Art

In recent years, with significant development of information and communication technology and semiconductor technology, supply and use of all types of portable terminals have rapidly increased. In particular, recent portable terminals have developed to include traditional fields as well as other terminal fields. For example, a mobile communication terminal provides multi-media functions such as a TV watching function (e.g., mobile broadcasting such as Digital Multimedia Broadcasting (DMB) or Digital Video Broadcasting (DVB)), a music playing function (e.g., MPEG Audio Layer-3 (MP3)), a moving image playback function as well as a general communication function such as speech call or message transmission/reception.

A portable terminal providing such multi-media functions generally provides an ear jack of 3.5 μl size. A 3 pole earphone and a 4 pole earphone may be mounted in the earphone. Accordingly, there is a need for an approach capable of recognizing a type of an earphone mount in the ear jack, and of performing a function according to the recognized type of the earphone by the portable terminal. To do this, when the earphone is mounted in the ear jack, the portable terminal detects generation of an interrupt signal according thereto, detects a voltage of the generated interrupt signal, recognizes a type of the earphone mounted in the ear jack based on the detected voltage, and performs an operation associated with the recognition result. The portable terminal may recognize an operation state of a key (e.g., call key, volume control key, or the like) mounted in the earphone based on the detected voltage of the interrupt signal.

The ear jack includes an interrupt terminal for recognizing a type of an earphone, an operation state of an earphone key, and the like. In a portable terminal of the related art, an interrupt terminal is disposed at an end of an ear jack hole to contact an end of an ear plug inserted in an ear jack hole. However, foreign materials may occasionally be inserted into an ear jack hole while a user is using the earphone, and the foreign materials may make a connection between an ear plug and an interrupt terminal unstable. An issue may arise in which a portable terminal cannot recognize a type of an ear. To address this issue, an interrupt terminal is installed in a side of an ear jack hole.

However, when the interrupt terminal is installed in a side of the ear jack hole, an interrupt signal is generated many times during a procedure of artificially inserting and separating the ear plug. Accordingly, the portable terminal may perform an erroneous operation which the user does not intend. If the user inserts an ear plug for a 4 pole earphone into an earphone hole, an interrupt terminal first contacts a right sound terminal of an earphone and accordingly an interrupt signal is generated and the portable terminal may recognize mounting of a 3 pole earphone. As the ear plug is further inserted into the ear jack hole, connection between a right sound terminal R of an earphone and the interruption terminal is released. According to the generated interrupt signal, the portable terminal may recognize separation of an ear phone.

Subsequently, when the ear plug is completely inserted into the ear jack hole, the interrupt terminal contacts a microphone terminal of the earphone. Accordingly, the interrupt signal is generated and the portable terminal may recognize mounting of a 4 pole phone. Although the portable terminal correctly recognizes that a 4 pole earphone is finally mounted, it may be recognized as 'separation' different from intention of a user. Accordingly, the portable terminal may perform an erroneous operation which the user does not intend. For example, as it is recognized as 'separation', the portable terminal may erroneously pause a played music.

When the user artificially separates an ear plug from an ear jack, an interrupt signal is generated many times and accordingly the portable terminal may perform an erroneous operation which the user does not intend. In addition, a noise is mixed with an interrupt signal generated while the ear plug is separated from an ear jack. Accordingly, an issue may arise in that an ear jack key (e.g., call key) is pushed in the portable terminal.

Furthermore, a connection state between an interrupt terminal and an ear plug is unstable to generate an interrupt signal and accordingly an erroneous operation may be performed. For example, although the ear plug is not separated from an ear jack, it can be recognized that a connection state of an earphone is separated due to a temporarily unstable connection state. The portable terminal may perform an erroneous operation that pauses a played music according to this recognition. Moreover, the portable terminal may perform an erroneous operation of changing an audio output path from an earphone to a speaker according to the erroneous recognition.

SUMMARY OF THE INVENTION

Aspects of the present invention are to address at least the above-mentioned problems and/or disadvantages and to provide at least the advantages described below. Accordingly, an aspect of the present invention is to provide a method of preventing an erroneous operation according to generation of an interrupt signal during separation and mounting procedures of an earphone, and an apparatus thereof Another aspect of the present invention is to provide a method of preventing an erroneous operation due to a unstable connection state between an interrupt terminal and an ear plug.

In accordance with an aspect of the present invention, a method of recognizing an earphone in a portable terminal is provided. The method includes detecting generation of an interrupt associated with a change in a connection state between the earphone and an interface unit, determining the connection state when the generation of the interrupt is detected, determining whether a preset stabilizing time for stabilizing the change in the connection state has elapsed, determining whether the determined connection state is identical with a connection state before the generation of the interrupt when the preset stabilizing time elapses, and maintaining the connection state before the generation of the interrupt when the determined connection state is identical with the connection state before the generation of the interrupt.

In accordance with another aspect of the present invention, an apparatus for recognizing an earphone in a portable terminal is provided. The apparatus includes an interface unit for connecting to the earphone, a controller for detecting generation of an interrupt associated with a change in a connection state between the earphone and the interface unit, for determining the connection state when the generation of the interrupt is detected, for determining whether a preset stabilizing time for stabilizing the change in the connection state has elapsed, for determining whether the determined connection state is identical with a connection state before the generation of the interrupt when the preset stabilizing time elapses, and for maintaining the connection state before the generation of the interrupt when the determined connection state is identical with the connection state before the generation of the interrupt, and an audio processor for encoding and outputting an audio signal received from the earphone to the controller, and for decoding and outputting an audio signal input from the controller to the earphone.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1:
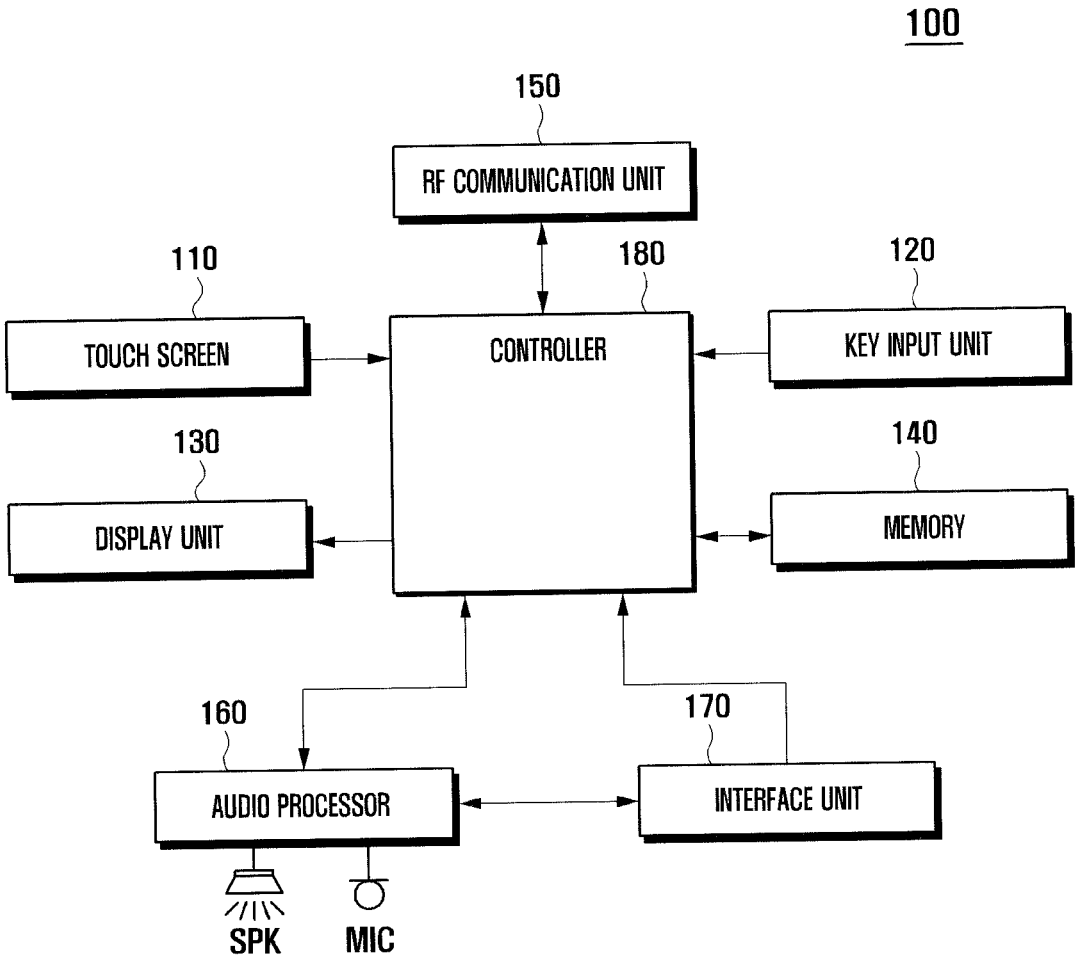
FIG. 1 is a block diagram illustrating a configuration of a portable terminal according to an exemplary embodiment of the present invention.

The following description with reference to the accompanying drawings is provided to assist in a comprehensive understanding of exemplary embodiments of the invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

A method and an apparatus for recognizing an earphone in a portable terminal according to an exemplary embodiment of the present invention is described below with reference to the accompanying drawings. The portable terminal may be any of various information and communication devices, multi-media devices, and application devices thereof, such as a digital broadcasting player, a Personal Digital Assistant (PDA), a Smart Phone, a tablet PC, and a hand-held PC, as well as various mobile communication terminals operating based on communication protocols corresponding to various communication systems. In the exemplary embodiments described below, the portable terminal is a smart phone.

The portable terminal may recognize whether an earphone is mounted and set an audio output path according to the recognition result. When an earphone is mounted, a controller of the portable terminal may control an audio processor to output audio to an earphone through an ear jack. When the ear phone is separated, the controller controls the audio processor to output the audio to a speaker. When it is recognized that the earphone is separated during playback of the audio, the controller may pause playback of the audio. The portable terminal may recognize a type of a mounted earphone and accordingly set a recognition state of a earphone key as 'recognition impossibility' or 'recognition possibility'.

If the mounted earphone is a 4 pole earphone, the controller of the portable terminal may detect whether an earphone key is operated. If the ear phone key is operated, the controller may perform an associated function (e.g., call, playback start, playback pause, volume control, etc.). The controller may detect generation of an interrupt signal, and confirm a voltage of the detected interrupt signal to detect an operation state of an earphone key. If the mounted earphone is a 3 pole earphone or an earphone is not mounted, the controller of the portable terminal may set a recognition state of the earphone key as 'recognition impossibility'. In this situation, the controller may not perform the associated function although generation of the interrupt signal is detected.

The portable terminal includes a 4 pole ear jack of a 3.5 pi size. The portable terminal may include a 4 pole ear jack with an interrupt terminal for recognizing a type of an earphone and an operation state of an earphone key. If the interrupt terminal contacts a terminal of an ear plug or the contact is released, the interrupt terminal generates and transfers an interrupt signal to a controller of the portable terminal. In a 4 pole ear jack according to an exemplary embodiment of the present invention, an interrupt terminal may be installed in a side of an ear jack hole to prevent unstable connection between an ear plug and an interrupt terminal due to foreign materials. When the ear plug is completely inserted into a hole of a 4 pole ear jack, the interrupt terminal may be installed to contact a microphone terminal of the ear plug.

If generation of an interrupt signal is detected, the portable terminal may determine a connection state (i.e., a mounting state of a 4 pole earphone, a mounting state of a 3 pole earphone, and a state in that an earphone is not mounted). The interrupt signal may be generated during a procedure of separating or mounting an ear plug. The interrupt signal may be generated due to a temporarily unstable connection state between the interrupt terminal and the ear plug. If generation of the interrupt signal is detected, the portable terminal may compare an earphone connection state before the generation of the interrupt signal with a current earphone connection state. When a connection state of the earphone is changed, the portable terminal may perform a function associated with the changed connection state. The portable terminal may disregard an interrupt signal generated for a stabilizing time to prevent an erroneous operation. In addition, a state of a portable terminal may be changed for the stabilizing time. In this case, the stabilizing time may be initialized.

An exemplary embodiment of the portable terminal according to the present invention is described below. Detailed descriptions of well-known functions and structures incorporated herein may be omitted to avoid obscuring the subject matter of the present invention.

FIG. 1 is a block diagram illustrating a configuration of a portable terminal according to an exemplary embodiment of the present invention.

Referring to FIG. 1, the portable terminal may include a touch screen 110, a key input unit 120, a display unit 130, a memory 140, a Radio Frequency (RF) communication unit 150, an audio processor 160, a speaker SPK, a microphone MIC, an interface unit 170, and a controller 180.

The touch screen 110 is mounted in a front surface of the display unit 130, and generates and transfers a touch event in response to a user operation with respect to the touch screen 110 to the controller 180. The controller 180 may control the foregoing elements in response to the touch event.

The user operation may be a touch, tap, double tap, press, drag, drag & drop, or sweep. The touch is an operation where a user touches one point of a screen. The tap is an operation where the user lifts a finger from a corresponding point without movement of the finger after touching one point. The double tap is an operation where a user taps twice. The press is an operation where the user lifts a finger from a corresponding point without movement of the finger after touching the touch screen 110 for a time period longer than the tap. The drag is an operation in which the user moves a finger in a predetermined direction while one point is touched. The drag & drop is an operation the user lifts the finger after drag. The sweep is an operation in which the user lifts the finger after moving the finger by bouncing at high speed. The drag may also be referred to as scroll and the sweep as flick. The controller 180 may distinguish the sweep and the drag with each other by moving speed. The touch screen 110 may be resistive type, a capacitive type, and/or a pressure type.

The key input unit 120 may include a plurality of input keys and function keys for receiving input of numerals and character information and for setting various functions. The function keys may include arrow keys, side keys, and short keys set such that a certain function is performed. The key input unit 120 generates and transfers a key signal associated with function control of the portable terminal to the controller 180. The key signal may be a power on/off signal, a volume control signal, a screen on/off signal, and the like. The controller 180 controls the foregoing elements in response to the foregoing key signal. The key input unit 120 may be implemented by a Qwerty key pad, a 3*4 key pad, a 4*3 key pad, or the like. The key input unit 120 may include only at least one side key for screen on/off and portable terminal on/off which is provided in a side of a case of the portable terminal when a touch screen 110 of the portable terminal is supported in a form of a full touch screen.

The display unit 130 converts image data input from the controller 180 into an analog signal, and displays the analog signal. The display unit 130 may provide various screens according to use of the portable terminal, such as a lock screen, a home screen, an application execution screen, a menu screen, a message creation screen, a call screen, an Internet screen, and a key pad screen. The lock screen may be an image displayed when a screen of the display unit 130 is turned on. If a certain touch event for lock release is generated, the controller 180 may switch the displayed image from the lock screen to the home screen or the application execution screen. The home screen may be an image including a plurality of application icons corresponding to a plurality of applications, respectively. If one icon is selected from a plurality of application icons, the controller 180 may execute a corresponding application and switch the displayed image to an execution screen of a corresponding application.

The display unit 130 may be a flat panel display such as a Liquid Crystal Display (LCD) or an Organic Light Emitted Diode (OLED). The display unit 130 may include a 3D implementing unit for displaying a left image and a right image, and allowing a user to feel depths of the left and right images. As would be known to those skilled in the art, a 3D implementing scheme is divided into a spectacle scheme and a non-spectacle scheme. The spectacle scheme includes a color filter scheme, a polarizing filter scheme, and a shutter glass scheme. The non-spectacle scheme includes a lenticular lens scheme and a parallax barrier scheme.

The memory 140 may store an Operating System (OS), applications necessary for the invention, and various data. The memory 140 may chiefly include a program area and a data area.

The data area of the memory 140 may store data generated by the controller 180 according to use of the portable terminal. The data area may store the foregoing screens output on the display unit 130. The data area may temporarily store data which the user copies in messages, photographs, web pages, documents, or the like for insertion or other operation. The data area may store various set values for an operation of the portable terminal (e.g., screen brightness, presence of vibration when a touch is generated, presence of automatic screen rotation, or the like) for operating the portable terminal. The data area according to an exemplary embodiment of the present invention may store a setting value associated with recognition possibility of an earphone key. The data area may store a setting value associated with a stabilizing time for determining presence of a change in a connected state of an earphone. If the portable terminal is booted or the foregoing interrupt signal is input from the interface unit 170, the controller 180 may detect a connected state of the earphone, set recognition possibility of an earphone key according to the detected result, and store the setting value in the data area.

The program area of the memory 140 may store an Operating System (OS) for booting a portable terminal and for operating respective elements, and applications for supporting various functions. The functions may include a user function for supporting a call function, a web browser for accessing an Internet server, an MP3 user function for playing other sound sources, an image output function, and a moving image playback function. The program area may store an earphone recognition application. If the portable terminal is booted, the earphone recognition application may be automatically executed. The ear recognition application may include a routine for recognizing whether an earphone is mounted, a routine for setting a recognition state of an earphone key, a routine for comparing an earphone connection state before generation of an interrupt signal with a current connection state of an earphone after a preset stabilizing time elapses if generation of the interrupt signal is detected, a routine for determining a connection state of the earphone as a changed state when the connection state of the earphone is changed as the comparison state and initializing the stabilizing time when a state is changed for the stabilizing time, and a routine for pausing audio playback when the earphone is separated during audio playback.

The RF communication unit 150 forms a communication channel for a voice call, a communication channel for an image call, and a communication channel for transmitting images or messages under the control of the controller 180. The RF communication unit 150 forms a voice call channel, a data communication channel, and an image call channel between mobile communication systems. The RF communication unit 150 may include an RF transmitter (not shown) up-converting a frequency of a transmitted signal and amplifying the signal and an RF receiver (not shown) low-noise-amplifying a received signal and down-converting the signal.

The audio processor 160 may be configured by an acoustic component transmitting/receiving an audio signal to perform encoding and decoding. The audio processor 160 may include a codec and an audio amplifier. The audio processor 160 is connected to a microphone MIC and a speaker SPK. The audio processor 160 may converts a speech signal input from the MIC into data, and transmit the data to the controller 180. The audio processor 160 may convert a speech signal input from the controller 180 into an analog signal, and output the analog signal through the SPK. The audio processor 160 may output various audio signals (e.g., MP3 files, audio signal according to playback of moving image files) generated from the portable terminal. When an earphone is connected, the audio processor 160 may transmit an audio signal to an earphone through a left acoustic terminal and a right acoustic terminal or receive a speech signal input through a microphone terminal of an ear jack.

The interface unit 170 performs data transmission/reception with a peripheral device in a wired or wireless communication scheme. The interface unit 170 of the invention includes an ear jack. The ear jack may be a 4 pole standard ear jack with 3.4 pi size. A 3 pole ear phone or a 4 pole earphone may be mounted in the ear jack. An interrupt terminal for recognizing a type of an earphone and an operation state of an earphone key may be installed in a side of the ear jack hole. The interrupt terminal may be arranged to contact a microphone terminal of an ear plug when a 4 pole earphone is completely inserted in an ear jack hole. The interrupt terminal may also be arranged to contact a ground terminal of an ear plug when a 3 pole earphone is completely inserted in an ear jack hole. The ear jack may transfer an audio signal input from the audio processor 160 to an earphone. The ear jack may transfer an audio signal input from a microphone to the audio processor 160. The ear jack may generate and transfer the interrupt signal to the controller 180.

The controller 180 may control an overall operation of the portable terminal and signal flow between internal elements of the portable terminal, and perform a function processing data, and execute various applications stored in a program area of the memory 140. The controller 180 may control power supply to internal elements in a battery. If the portable terminal is booted, the controller 180 may automatically execute the foregoing earphone recognition application. An exemplary embodiment associated with execution of a function of the controller 180, particularly, an earphone recognition application, is described below with reference to accompanying drawings.

The foregoing portable terminal 100 may further include various additional modules according to provision forms. When the portable terminal 100 is a communication terminal, the portable terminal 100 may include modules that are not mentioned, such as a near distance communication module for near distance communication, an interface exchanging data in a wired communication scheme or a wireless communication scheme of the portable terminal 100, an Internet communication module communicating with an Internet to perform an Internet function, and a digital broadcasting module receiving and broadcasting digital broadcasting. Since the structural elements may change according to convergence trend of a digital device, these elements are omitted. The portable terminal 100 may include structural elements equivalent to the foregoing structural elements. The portable terminal 100 may be substituted by specific constructions in the foregoing arrangements according to the provided form or another structure. This can be easily understood to those skilled in the present art.

Figure 2:
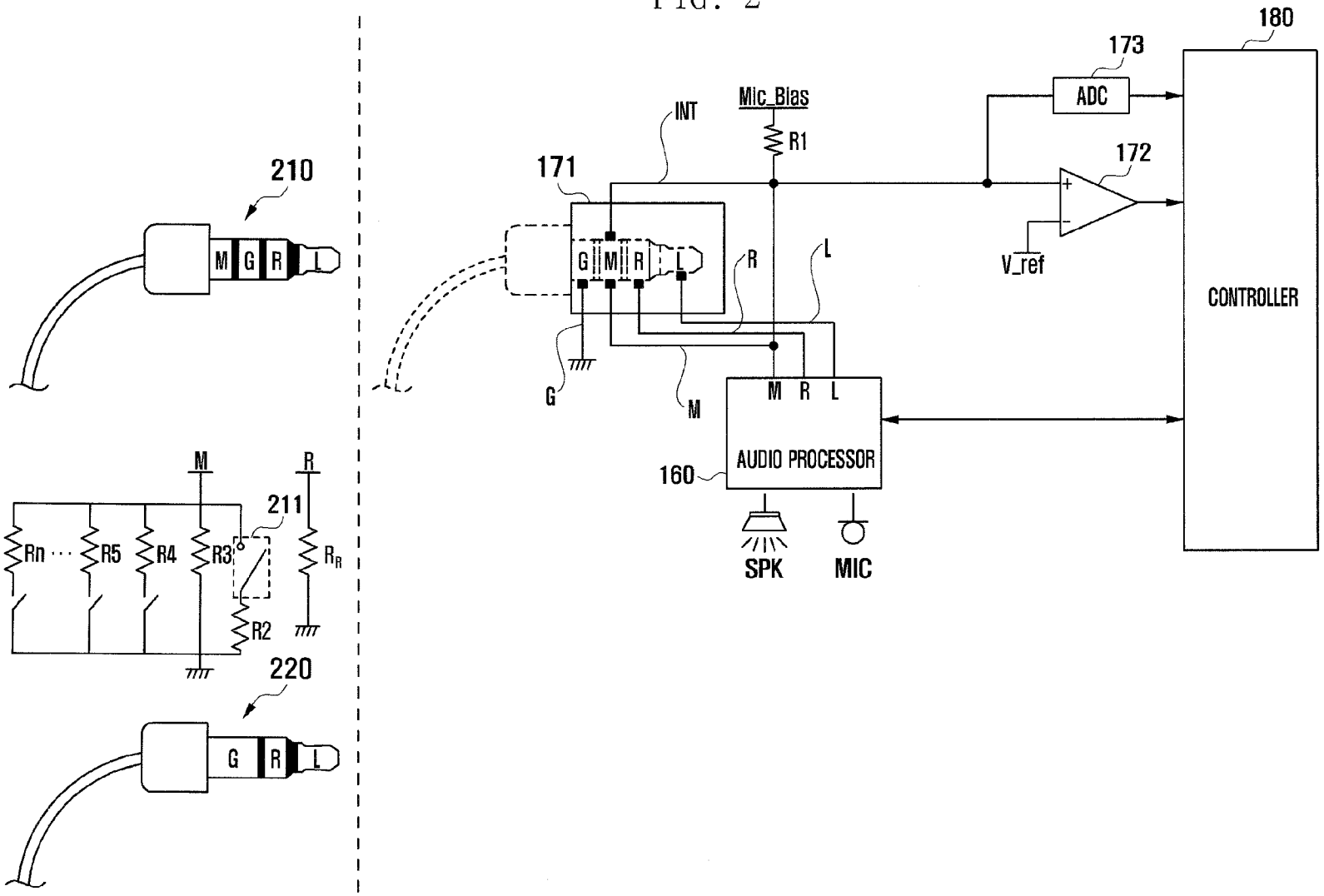
FIG. 2 is a diagram illustrating a configuration of an interface unit according to an exemplary embodiment of the present invention.

FIG. 2 is a diagram illustrating a configuration of an interface unit according to an exemplary embodiment of the present invention.

Referring to FIG. 2, the interface unit 170 may include an ear jack 171, an interrupt generator 172, and an Analog/Digital (A/D) converter 173. The interrupt generator 172 and the A/D converter 173 may be disposed between the ear jack 171 and the controller 180. The interrupt generator 172 and the A/D converter 173 may be disposed inside the controller 180. The interrupt generator 172 and the A/D converter 173 may be disposed between the ear jack 171 and the controller 180.

The ear jack 171 may include a body with a hole in which the earphone is inserted, a ground terminal G, a microphone terminal M, a right acoustic terminal R, a left acoustic terminal L, and an interrupt terminal INT disposed in an inner side of the body. If a 4 pole earphone 210 is completely inserted into an ear jack 171, a ground terminal G of an ear jack 171 contacts with a ground terminal G of a 4 pole earphone 210, a microphone terminal M of the ear jack 171 contacts a microphone terminal M of the 4 pole earphone 210, a right acoustic terminal R of the ear jack 171 contacts a right acoustic terminal R of the 4 pole earphone 210, a left acoustic terminal L of the ear jack 171 contacts a left acoustic terminal L of the 4 pole earphone 210, and an interrupt terminal INT of the ear jack 171 is connected to the microphone terminal M of the 4 pole earphone 210. If a 3 pole earphone 220 is completely inserted into an ear jack 171, a ground terminal G of an ear jack 171 contacts with a ground terminal G of a 3 pole earphone 220, a microphone terminal M of the ear jack 171 contacts a microphone terminal M of the 3 pole earphone 220, a right acoustic terminal R of the ear jack 171 contacts a right acoustic terminal R of the 3 pole earphone 220, a left acoustic terminal L of the ear jack 171 contacts a left acoustic terminal L of the 3 pole earphone 220, and an interrupt terminal INT of the ear jack 171 is connected to the ground terminal G of the 3 pole earphone 220.

The ground terminal G of the ear jack is connected to a ground, the microphone terminal M of the ear jack 171 is connected to a microphone bias power Mic_Bias through a pull-up resistor R1, and the microphone terminal M is connected to a microphone input terminal M of an audio processor 160. The right acoustic terminal R of the ear jack 171 is connected to a right acoustic output terminal R of the audio processor 160, and a left acoustic terminal L of the ear jack 171 is connected to a left acoustic output terminal L of the audio processor 160. An interrupt terminal INT of the ear jack 171 is connected to the interrupt generator 172 and the A/C converter 173, and is connected to a microphone bias power Mic_Bias through a pull-up resistor R1.

The interrupt generator 172 generates an interrupt signal. As shown in FIG. 2, the interrupt generator 172 may be a comparator. The interrupt generator 172 may compare an output voltage of an interrupt terminal INT of an ear jack 171 with a preset reference voltage V_ref to a low level signal or a high level signal. For example, when the interrupt generator 172 is not connected to a terminal (namely, G, M, R or L) of the earphone, the interrupt generator 172 may be configured to output a low level signal. When the interrupt generator 172 is connected to the terminal of the earphone, it may be configured to output a high level signal. When the interrupt generator 172 is not connected to the terminal of the earphone, the interrupt generator 172 may be configured to output a high level signal. When the interrupt generator 172 is connected to the terminal of the earphone, it may be configured to output a low level signal. The output signal of the interrupt generator 172 is transferred to the controller 180. Accordingly, when a level of a signal input from the interrupt generator 172 is switched from low to high or from high to low, the controller 180 determines that interrupt (namely, change in a connection state or an operation state of an earphone) is generated.

The A/D converter 173 converts an analog voltage into a digital voltage. An input terminal of the A/D converter 173 may be connected to an interrupt terminal INT of the ear jack 171 and a microphone bias power Mic_Bias. An output terminal of the A/D converter 173 may be connected to the controller 180. The A/D converter 173 may convert an analog voltage input to an input terminal into a digital voltage and transfer the digital voltage to the controller 180. The controller 180 compares a voltage input from the A/D converter 173 with a stored recognition table to recognize a connection state of an earphone and an operation state of the earphone key. The memory 140 may store the recognition table. The recognition table is illustrated below in Table 1. If an input voltage is 3.3V (microphone bias power), the controller 180 recognizes it as "earphone separation". If the input voltage is 3.0V, the controller 180 recognizes that a 4 pole earphone 210 is mounted. If the input voltage is 0.6V, the controller 180 recognizes that a call key 211 is pushed. If the input voltage is 0.0V, the controller 180 recognizes that a 3 pole earphone 220 is mounted. Table 1 is a merely example. However, exemplary embodiments of the present invention are not limited thereto. The interface unit 170 and the recognition table may be variously changed according to intention of a user.

TABLE 1

| Input voltage (V) | Classification |
|---|---|
| 3.30 | Separate Earphone |
| 3.00 | Mount 4 pole earphone |
| 2.80 | Reserved |
| 2.58 | Reserved |
| 2.41 | Reserved |
| 2.20 | Reserved |
| 1.98 | Reserved |
| 1.80 | Push volume up key |
| 1.57 | Push volume down key |
| 1.38 | Reserved |
| 1.18 | Reserved |
| 1.00 | Reserved |
| 0.78 | Reserved |
| 0.60 | Call key push |
| 0.38 | Reserved |
| 0.18 | Reserved |
| 0.00 | Mount 3 pole earphone |

Figure 3:
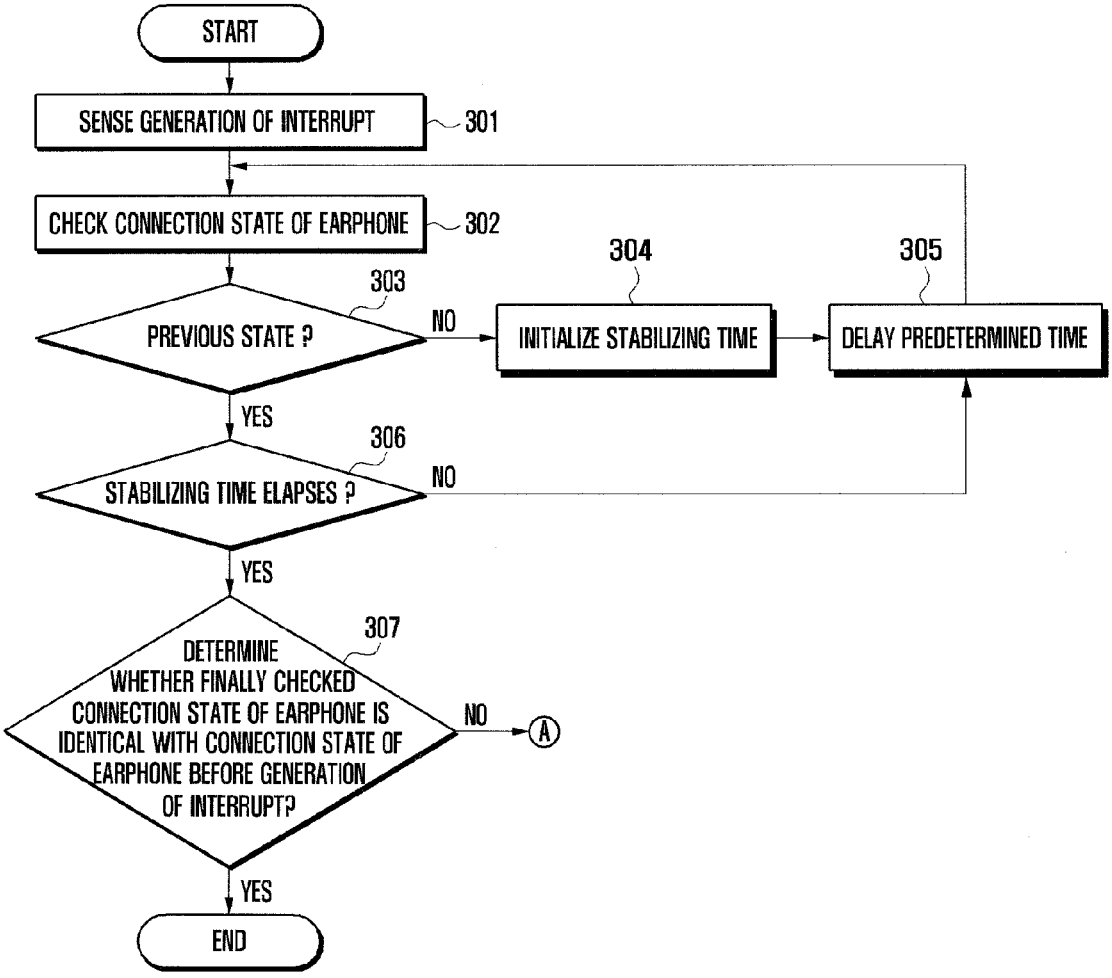
FIG. 3 and FIG. 4 are flowcharts illustrating a method of recognizing an earphone in a portable terminal according to an exemplary embodiment of the present invention.
Figure 4:
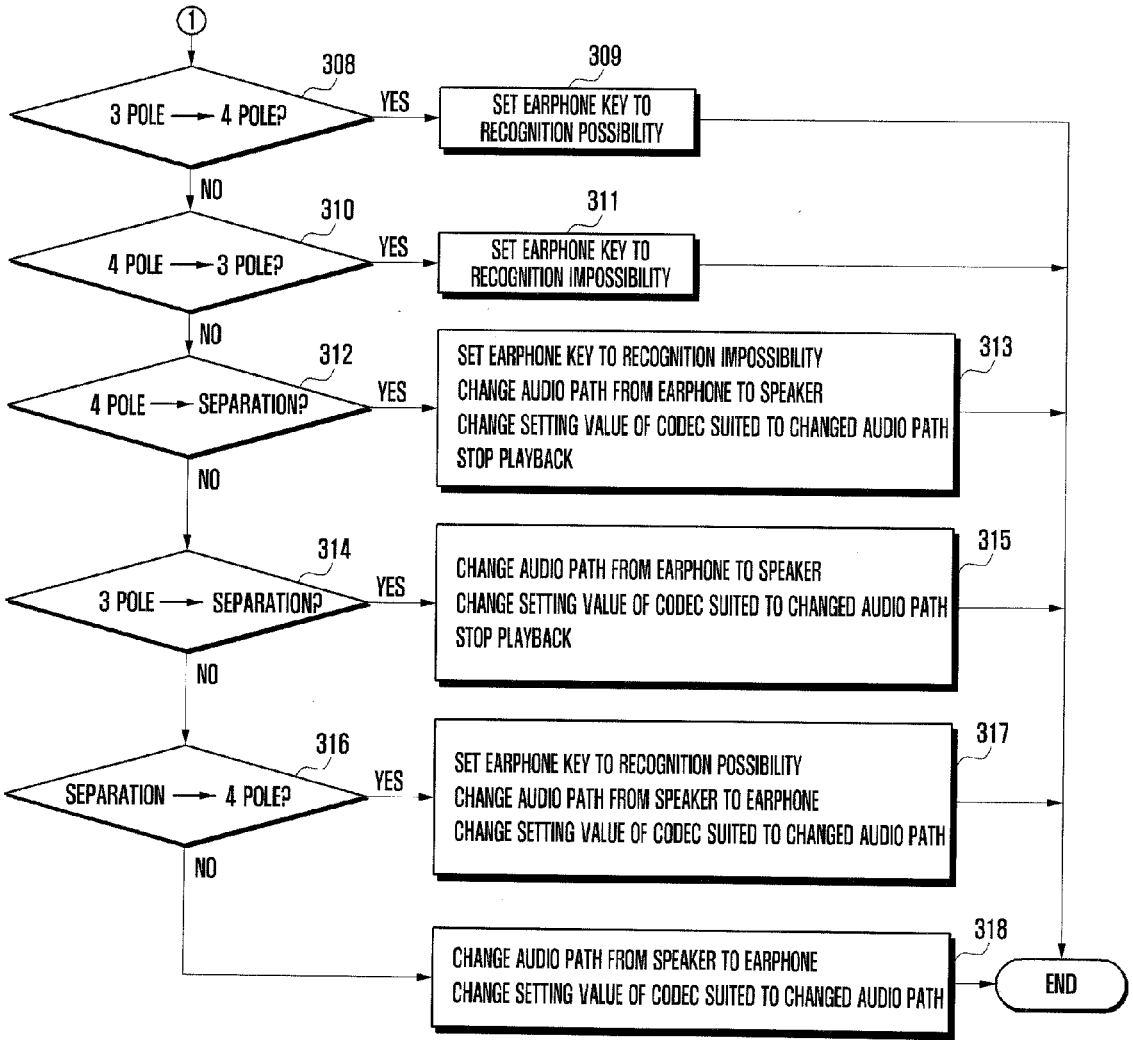

FIG. 3 and FIG. 4 are flowcharts illustrating a method of recognizing an earphone in a portable terminal according to an exemplary embodiment of the present invention.

Referring to FIG. 3 and FIG. 4, the controller 180 receives a high level signal or a low level signal from the interrupt generator 172. If a level of a received signal is switched either from low to high or from high to low, the controller 180 detects the generation of the interrupt in step 301. The controller 180 determines a connection state of an earphone based on a voltage input from an A/D converter 173 in step 302. The controller 180 determines whether the connection state of the earphone is identical with a 'previous state' in step 303. If the connection state of the earphone differs from the 'previous state', the controller 180 initializes a stabilizing time in step 304. Subsequently, after a predetermined time in step 305, the controller 180 returns to step 302. If the connection state of the earphone is identical with the 'previous state', the controller 180 determines whether the stabilizing time elapses in step 306. If the stabilizing time does elapse, after the predetermined time is delayed in step 305, the controller 180 returns to step 302. If the stabilizing time elapses, the controller 180 goes to step 307. As illustrated above, if the interrupt signal is generated, the controller 180 repeatedly determines a connection state of the earphone in step 302 until the stabilizing time elapses. Accordingly, the 'previous state' denotes a connection state of an earphone directly before a current state of an earphone is determined. If step 302 is performed first after generation of the interrupt, the 'previous state' denotes a connection state of the currently checked earphone. The stabilizing time starts counting when the interrupt is generated. The stabilizing time may be determined when a user slowly inserts the earphone in the ear jack.

In step 307, the controller 180 determines whether a finally determined connection state of an earphone after the stabilizing time elapses is identical with a connection state of the earphone before the interrupt is generated at step 301. If the finally determined connection state of an earphone is identical with the connection state of the earphone before the interrupt is generated, the controller 180 regards that there is no state change, and maintains a connection state before generation of the interrupt. Because the interrupt is generated, a state change may be actually achieved.

However, if states before and after the stabilizing time are identical with each other, the user may regard that it is not a change in an intended state. For example, as illustrated above, 'separation' recognized in a procedure that the user inserts an earphone in an ear jack may be a change in a state which the user does not intend. Further, 'separation' recognized in a procedure that the user separates the earphone from the ear jack may be change in an unintended state by the user. Moreover, 'separation' generated due to a temporarily unstable contact state between the interrupt terminal and the ear plug may be change in an unintended state by the user. Accordingly, an unintended erroneous operation of the user, for example, pause of played music or change in an audio path may be prevented.

If the finally determined connection state of an earphone differs from the connection state of the earphone before the interrupt is generated as the determination result of step 307, the controller 180 sets a connection state between an earphone and an ear jack to a changed connection state. The controller 180 determines whether the state of a mounted earphone is switched from a 3 pole to a 4 pole in step 308. When the state of a mounted earphone is switched from the 3 pole to the 4 pole, the controller 180 sets a setting value associated with an earphone key to 'recognition possibility' in step 309. The controller 180 detects whether an earphone key is operated in the set state. If the operation of the earphone key is detected, the controller 180 executes a function (e.g., call, volume up) associated with the detected key. If audio or video is played, the controller 180 may maintain the playback regardless of state change from the 3 pole to the 4 pole.

The controller 180 determines whether the state of a mounted earphone is switched from a 4 pole to a 3 pole in step 310. When the state of a mounted earphone is switched from the 4 pole to the 3 pole, the controller 180 sets a setting value associated with an earphone key to 'recognition impossibility' in step 311. In this state, the controller 180 may not detect whether the earphone key is operated. In addition, although the operation of the earphone key is detected, the controller 180 may not perform a relation function. If video is played, the controller 180 may maintain the playback of the video regardless of state change from the 4 pole to the 3 pole.

The controller 180 determines whether a 4 pole earphone is separated from an ear jack in step 312. If the 4 pole earphone is separated from the ear jack, the controller 180 sets a setting value associated with an earphone key to 'recognition impossibility' in step 313. The controller 180 may change an audio path from an earphone to a speaker. The controller 180 may change a setting value of a codec suited to the changed audio path. In addition, if the audio or the video is played, the controller 180 may pause the playback.

The controller 180 determines whether a 3 pole earphone is separated from the ear jack in step 314. If the 3 pole earphone is separated from the ear jack, the controller 180 may change an audio path from an earphone to a speaker in step 315. Simultaneously, the controller 180 may change a setting value of a codec suited to the changed audio path. In addition, if the audio or the video is played, the controller 180 may pause the playback.

The controller 180 determines whether the 4 pole earphone is mounted in step 316. If the 4 pole earphone is mounted, the controller 180 sets a setting value associated with an earphone key to 'recognition possibility' in step 317. The controller 180 may change an audio path from the speaker to the earphone. Simultaneously, the controller 180 may change a setting value of a codec suited to the changed audio path.

If the 3 pole earphone is mounted, the controller 180 may change the audio path from the speaker to the earphone in step 318. Simultaneously, the controller 180 may change a setting value of a codec suited to the changed audio path.

A method for recognizing an earphone according to an exemplary embodiment of the present invention as described above may be implemented in an executable program command form by various computer means and be recorded in a computer readable recording medium. In this case, the computer readable recording medium may include a program command, a data file, and a data structure individually or a combination thereof. The program command recorded in a recording medium may be specially designed or configured for the present invention or be known to a person having ordinary skill in a computer software field to be used.

The computer readable recording medium includes Magnetic Media such as hard disk, floppy disk, or magnetic tape, Optical Media such as Compact Disc Read Only Memory (CD-ROM) or Digital Versatile Disc (DVD), Magneto-Optical Media such as floptical disk, and a hardware device such as ROM. RAM, flash memory storing and executing program commands. Further, the program command includes a machine language code created by a complier and a high-level language code executable by a computer using an interpreter. The foregoing hardware device may be configured to be operated as at least one software module to perform an operation of the present invention, and a reverse operation thereof is the same.

According to an exemplary embodiment of the invention, a consistent operation of a user (i.e., operation for separating an earphone from an ear jack or operation for inserting the earphone into the ear jack) may be recognized, and accordingly, the user's experience is improved. An erroneous operation according to generation of an interrupt signal during separation and mounting operations of an earphone may be prevented. In addition, an erroneous operation due to a unstable contact state between an interrupt terminal and an ear plug may also be prevented.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method of recognizing an earphone in a portable terminal, the method comprising:

detecting generation of an interrupt associated with a change in a connection state between the earphone and an interface unit;

determining the connection state when the generation of the interrupt is detected;

determining whether a preset stabilizing time for stabilizing the change in the connection state has elapsed;

determining whether the determined connection state is identical with a connection state before the generation of the interrupt when the preset stabilizing time elapses; and maintaining the connection state before the generation of the interrupt when the determined connection state is identical with the connection state before the generation of the interrupt.

2. The method of claim 1, further comprising initializing the stabilizing time when the connection state changes before the stabilizing time elapses.

3. The method of claim 1, further comprising setting the connection state between the earphone and the interface unit to the determined connection state when the determined connection state differs from the connection state before the generation of the interrupt.

4. The method of claim 3, wherein the setting of the connection state between the earphone and the interface unit comprises:

setting a setting value associated with the earphone key to 'recognition possibility' when an earphone mounted in the interface unit is changed from a 3 pole earphone to a 4 pole earphone; and setting the setting value associated with an earphone key to 'recognition impossibility' when the earphone mounted in the interface unit is changed from the 4 pole earphone to the 3 pole earphone.

5. The method of claim 4, further comprising determining whether the earphone key is operated when the setting value associated with the earphone key is set to the 'recognition possibility'.

6. The method of claim 3, further comprising maintaining playback of audio or video regardless of state change either from the 3 pole earphone to the 4 pole earphone or from the 4 pole earphone to the 3 pole earphone when the audio or the video is played.

7. The method of claim 3, further comprising stopping playback when the determined connection state is separation of the earphone.

8. An apparatus for recognizing an earphone in a portable terminal, the apparatus comprising:

an interface unit configured to connect to the earphone;

a controller configured to:

detect generation of an interrupt associated with a change in a connection state between the earphone and the interface unit, determine the connection state when the generation of the interrupt is detected, determine whether a preset stabilizing time for stabilizing the change in the connection state has elapsed, determine whether the determined connection state is identical with a connection state before the generation of the interrupt when the preset stabilizing time elapses, and maintain the connection state before the generation of the interrupt when the determined connection state is identical with the connection state before the generation of the interrupt; and an audio processor configured to:

encode and output an audio signal received from the earphone to the controller, and decode and output an audio signal input from the controller to the earphone.

9. The apparatus of claim 8, wherein the controller initializes the stabilizing time when the connection state changes before the stabilizing time elapses.

10. The apparatus of claim 8, wherein the controller sets the connection state between the earphone and the interface unit to the determined connection state when the determined connection state differs from the connection state before the generation of the interrupt.

11. The apparatus of claim 10, wherein the controller sets a setting value associated with the earphone key to 'recognition possibility' when an earphone mounted in the interface unit is changed from a 3 pole earphone to a 4 pole earphone; and sets the setting value associated with an earphone key to 'recognition impossibility' when the earphone mounted in the interface unit is changed from the 4 pole earphone to the 3 pole earphone.

12. The apparatus of claim 11, wherein the controller determines whether the earphone key is operated when the setting value associated with the earphone key is set to the 'recognition possibility'.

13. The apparatus of claim 10, wherein the controller maintains playback of audio or video regardless of state change either from the 3 pole earphone to the 4 pole earphone or from the 4 pole earphone to the 3 pole earphone when the audio or the video is played.

14. The apparatus of claim 10, wherein the controller stops playback when the determined connection state is separation of the earphone.

15. The apparatus of claim 8, wherein the interface unit comprises an ear jack connectable with a 3 pole earphone or a 4 pole earphone.

16. The apparatus of claim 15, wherein the ear jack comprises a ground terminal, a microphone terminal, a right acoustic terminal, a left acoustic terminal, and an interrupt terminal causing such that the controller recognizes a connection state between the earphone and the interface unit, and wherein the interrupt terminal is installed in an inner side of the ear jack to contact a microphone terminal of the 4 pole ear when the 4 pole earphone is mounted in the ear jack.

17. The apparatus of claim 16, wherein the interface unit further comprises:

an interrupt generator connected to the interrupt terminal for generating and outputting an interrupt signal to the controller according to variation in an output voltage of the interrupt terminal; and an Analog/Digital (A/D) converter connected to the interrupt terminal for converting an output voltage of the interrupt terminal into a digital voltage and outputting the digital voltage to the controller.

18. The apparatus of claim 17, wherein the controller determines that the connection state is changed when a level of an interrupt signal input from the interrupt generator is switched either from low to high or from the high to the low, and determines the connection state based on a voltage input from the A/D converter.

* * * * *